US005130218A

United States Patent [19]

Yokokawa et al.

[11] Patent Number: 5,130,218

[45] Date of Patent: Jul. 14, 1992

[54] ELECTROPHOTOGRAPHIC PHOTORECEPTOR PROVIDING A STABLE HIGH CHARGE ABILITY AND LOW DARK DECAY COEFFICIENT

[75] Inventors: Motoko Yokokawa; Seiji Ashiya, both of Kanagawa, Japan

[73] Assignee: Fuji Xerox Co., Ltd., Tokyo, Japan

[21] Appl. No.: 554,185

[22] Filed: Jul. 20, 1990

Related U.S. Application Data

[63] Continuation of Ser. No. 234,658, Aug. 22, 1988, abandoned.

[30] Foreign Application Priority Data

Aug. 27, 1987 [JP] Japan ..... 62-211323

[51] Int. Cl.[5] ..... G03G 5/06

[52] U.S. Cl. ..... 430/71; 430/135

[58] Field of Search ..... 430/58, 70, 75, 71, 430/135; 540/143

[56] References Cited

U.S. PATENT DOCUMENTS 4,701,396 10/1987 Hung et al. ..... 430/58
4,771,133 9/1988 Liebermann et al. ..... 540/143

FOREIGN PATENT DOCUMENTS 47-18544 9/1972 Japan .
62-206558 9/1987 Japan .

*Primary Examiner*—John Goodrow
*Attorney, Agent, or Firm*—Finnegan, Henderson, Farabow, Garrett and Dunner

[57] ABSTRACT

An electrophotographic photoreceptor which employs a photosensitive layer including a binder resin and an organic pigment as a charge generating material which has been subjected to an acid pasting treatment. The sulfur content of the organic pigment is maintained at 500 ppm or less to achieve a stable high chargeability and low dark decay coefficient.

8 Claims, 1 Drawing Sheet

ELECTROPHOTOGRAPHIC PHOTORECEPTOR PROVIDING A STABLE HIGH CHARGE ABILITY AND LOW DARK DECAY COEFFICIENT

This application is a continuation of application Ser. No. 07/234,658, filed Aug. 22, 1988, now abandoned.

FIELD OF THE INVENTION

This invention concerns electrophotographic photoreceptor in which an organic pigment having a limited sulfur content is used as a charge generating material.

BACKGROUND OF THE INVENTION

Various materials have been used as charge generating materials in electrophotographic photoreceptors in the past. Charge generating materials can be broadly classified as inorganic pigments, such as selenium, zinc oxide or cadmium sulfide, or organic pigments.

A variety of organic pigments are used in the so-called organic photoreceptor, in which the organic pigments are used in electrophotographic photoreceptors. Typical examples of the organic pigments include the polycyclic quinone-based pigments, such as dibromoanthoanthrone, dibenzylpyrenequinone pigments, pyranthrone pigments, perylene pigments, and phthalocyanine-based pigments, such as non-metallic phthalocyanines, vanadium phthalocyanine, copper phthalocyanine etc. (For example, see JP-A-47-18544) (the term "JP-A" as used herein means an "unexamined published Japanese patent application.")

The grain size of an organic pigment is reduced and rendered uniform when the pigment used in the electrophotographic photoreceptor is subjected to an acid pasting treatment in which the pigment is reprecipitated by dilution with water and this technique has already been proposed as a way of providing electrophotographic photoreceptors which have good electrophotographic characteristics (see JP-A-62-206558).

However, differences arise in the chargeabilities and dark decay coefficient of the electrophotographic photoreceptors obtained when such pigments are used in electrophotographic photoreceptors, even when the photosensitive layers are formed using the same type of organic pigment. Therefore, the electrophotographic characteristics of the products are variable and suffer from the disadvantage that products which have low chargeability and a high dark decay coefficient are often obtained.

SUMMARY OF THE INVENTION

Hence, an object of the present invention is to provide electrophotographic photoreceptors which have a high chargeability and a low dark decay coefficient. A further object is to provide photoreceptors in which there is no variation in electrophotographic characteristics such as chargeability and the like.

The inventors have investigated the above problems, and as a result, have discovered that the difficulties indicated above are dependent on the sulfur content of the organic pigments which are used.

To achieve the objects of the present invention, there is provided an electrophotographic photoreceptor comprising an electrically conductive support having thereon a photosensitive layer containing a binder and an organic pigment which is subjected to an acid pasting treatment, as a charge generating material, wherein the sulfur content of said organic pigment is 500 ppm or less.

DETAILED DESCRIPTION OF THE INVENTION

Electrophotographic photoreceptors in accordance with the present invention are described below with reference to the accompanying drawings.

Figure 1:
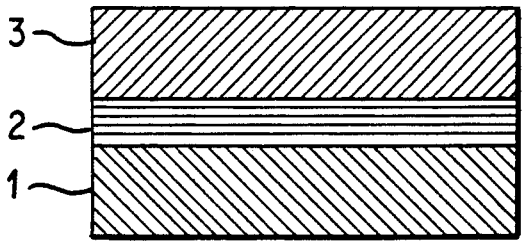
FIGS. 1 to 6 are diagrams which show the structures of various electrophotographic photoreceptors according to the present invention.
Figure 2:
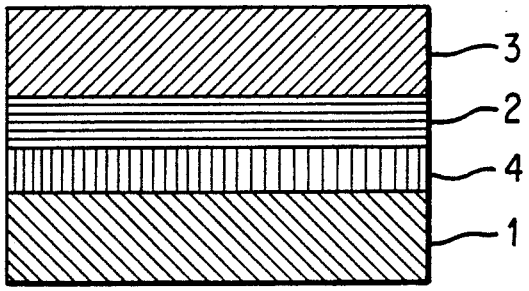
Figure 3:
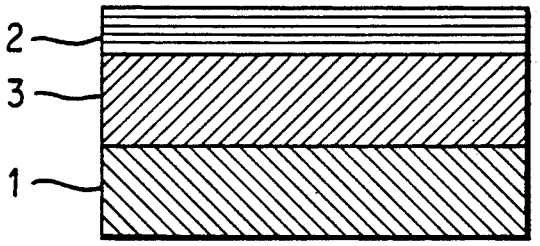
Figure 4:
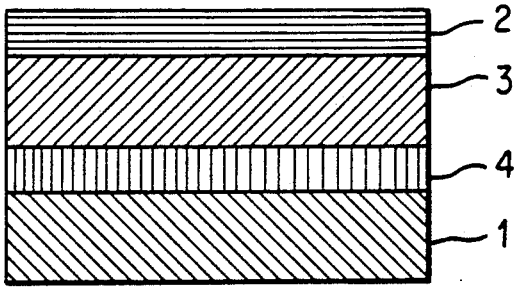

FIGS. 1 to 6 are diagramatic representations of the layer structures of electrophotographic photoreceptors of the present invention. FIGS. 1 to 4 are examples in which the photosensitive layer is of the laminated type. As used herein, the term "photosensitive layer" may indicate a plurality of component layers or a single layer. In FIG. 1, a charge generating layer 2 is formed on the surface of an electrically conductive support 1 and a charge transporting layer 3 is established on the surface of the charge generating layer 2. In FIG. 3, the charge transporting layer 3 is formed on the electrically conductive support 1 and the charge generating layer 2 is formed on the surface of the charge transporting layer 3. In FIGS. 2 and 4, an undercoating layer 4 is first established on the electrically conductive support 1 before forming the charge generating 2 and charge transporting layers 3 as described above.

Figure 5:
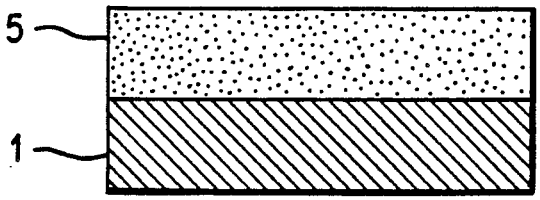
Figure 6:
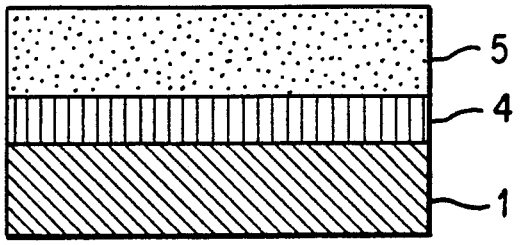

FIGS. 5 and 6 show examples of electrophotographic photoreceptors in which the photosensitive layer has a single layer structure. In FIG. 5, the single photoconductive layer 5 is established on the electrically conductive support 1, while in FIG. 6, an undercoating layer 4 is first established on the electrically conductive support 1 and then covered by the photoconductive layer 5.

In the electrophotographic photoreceptors of the present invention, an organic pigment is included as a charge generating material in the charge generating layer 2, and in the single layer structure, the pigment is in photoconductive layer 5. The sulfur content of the organic pigment is 500 ppm or less, and preferably is 400 ppm or less. This sulfur content signifies the sulfur content of the pigment itself, as well as the sulfur contained in the form of free sulfur or sulfur compounds which are present as impurities. The chargeability of the electrophotographic photoreceptor is reduced and the dark decay coefficient also is reduced if the sulfur content of the pigment exceeds 500 ppm.

The organic pigments which can be used in the present invention include: polycyclic quinone type pigments, such as dibromoanthoanthrone, chlorinated anthoanthrone, dibenzylpyrenequinone, pyrenequinone, brominated dibenzylpyrenequinone, pyranthrone, brominated pyranthrone, biolanthrone, isobiolanthrone, dianthraquinone, benzoanthroneacridine, acridonecarbazole, dinaphthroylacridone, anthraquinonethiazole, flavanthrone, perylene pigments; and phthalocyanine based pigments, such as non-metallic phthalocyanines, vanadium phthalocyanine, copper phthalocyanine and the like. Among these, dibromoanthoanthrone and perylene pigments are preferred. These organic pigments are generally prepared using an acid pasting treatment with sulfuric acid, but the acid pasted pigment should not contain more than 500 ppm of sulfur.

The acid pasting treatment of the organic pigment involves dissolving the pigment in concentrated sulfuric acid and dripping the solution into water to re-precipitate the pigment. A treatment such as that indicated below, for example, may be carried out to provide a sulfur content not exceeding 500 ppm. One part of pigment is dissolved in at least 30 parts of concentrated sulfuric acid and the solution is stirred at 10° C. for a period of 3 hours. The solution is then drip-fed into at least 200 parts of water which is being maintained at a temperature of 3° to 5° C. and the pigment is precipitated therein. The use of at least 200 parts of water at this time is important in obtaining a pigment with a low sulfur content. Furthermore, the pigment is subsequently recovered by filtration and washed with water. It is important to use at least 1000 parts of water relative to the pigment at this time. The pigment is subsequently dried at 100° C. until the water content is 0.1% or less.

When the electrophotographic photoreceptors of the present invention have a laminated structure as shown in FIGS. 1 to 4, the charge generating layer consists of the above mentioned organic pigments and a binder resin. The binder can be selected from a wide range of insulating resins or it may be selected from organic photoconductive resins such as poly-N-vinylcarbazole, polyvinylanthracene, polyvinylpyrene and the like. The preferred binders are insulating resins such as polyvinylbutyral, polyarylate (condensates of bisphenol A and phthalic acid), polycarbonate, polyester, phenoxy resin, vinyl chloride/vinyl acetate copolymer, poly(vinyl acetate), acrylic resin, polyacrylamide, polyamide, polyvinylpyridine, cellulose based resin, urethane resin, epoxy resin, casein, poly(vinyl alcohol), and polyvinylpyrrolidone, etc.

The first step in forming the charge generating layer is to prepare a coating solution by dispersing the above mentioned pigment in a liquid solution obtained by dissolving the above mentioned binder in an organic solvent. Then, this coating solution is coated onto an electrically conductive support, an undercoating layer, or a charge transporting layer, as desired, and finally the coating is dried.

The mixing ratio of the organic pigment to the binder is in the range of from 40/1 to ¼ and preferably from 20/1 to ½, parts by weight. If the proportion of pigment is too higher, the stability of the coating solution is reduced, and if the proportion of pigment is too lower, the sensitivity is reduced, and so the proportion of pigment is preferably set within the range indicated above. The solvent used is preferably selected from among those which do not dissolve the undercoating layer or the charge transporting layer. Examples of organic solvents which can be used include: alcohols such as methanol, ethanol, and isopropanol; ketones such as acetone, methyl ethyl ketone, and cyclohexanone; amides such as N,N-dimethylformamide, and N,N-dimethylacetamide; dimethylsulfoxide; ethers such as tetrahydrofuran, dioxan, ethylene glycol, and monomethyl ether; esters such as methyl acetate, and ethyl acetate; halogenated aliphatic hydrocarbons such as chloroform, methylene chloride, dichloroethylene, carbon tetrachloride, and trichloroethylene; and aromatic hydrocarbons such as benzene, toluene, xylene, ligroin, monochlorobenzene, and dichlorobenzene.

Methods such as the dip coating method, spray coating method, spinner coating method, bead coating method, Mayer bar coating method, blade coating method, roller coating method, and curtain coating method can be used to apply the coating solution. After the coating is applied, it is dried, preferably by touch drying at room temperature. Hot drying may be carried out at a temperature ranging from 30° to 200° C. over a period of from 5 minutes to 2 hours under still conditions or with a forced draft. The coating of the charge generating layer has a film thickness ranging generally from 0.05 to 5 ηm, and preferably from 0.1 to 3 ηm.

The charge transporting layer is made of a charge transporting material and a binder resin. Any known charge transporting materials can be used for the charge transporting material. For example, the compounds represented by formula [I] below, hydrazone based compounds and pyrazolene based compounds can be used effectively, and the same insulating resins as described above for use in forming this charge generating layer can also be used for the binder.

[I]

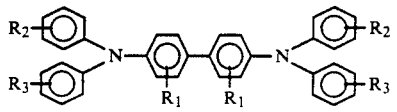

wherein $R_1$ and $R_2$ each represents hydrogen atoms or methyl groups, which may be the same or different, and $R_3$ represents a hydrogen atom, a methyl group or a halogen atom.

The charge transporting layer is formed in the same way as above after preparing a coating solution using the same organic solvents as mentioned above for use in forming this charge generating layer. The mixing ratio of charge transporting material to insulating binder preferably ranges from 5/1 to 1/5, and more preferably ranges from 3/1 to 1/3, by weight. The thickness of the charge transporting layer is preferably 5/50 μm and more preferably from 10 to 30 μm.

When the photosensitive layer has a monolayer structure as shown in FIGS. 5 and 6, the photosensitive layer consists of a photoconductive layer having a structure in which the above mentioned organic pigments are dispersed in a layer consisting of charge transporting material and binder. In this case the mixing ratio of the charge transporting material to the binder ranges preferably from about 1/20 and 20/1 and more preferably from 1/10 to 10/1 parts by weight. The mixing ratio of the organic pigment to the charge transporting material ranges preferably from 1/20 and 1/1 and more preferably from 1/10 to 1/1. The charge transporting materials and binders used are the same as those described above and the photoconductive layer is formed in the same way as before. The thickness of the photoconductive layer is formed in the same way as before. The thickness of the photoconductive layer preferably ranges from 10 to 80 μm.

Any of the known supports used for electrophotographic photoreceptors can be used for the electrically conductive support. Examples of such support include metal plates, metal drum, or metal foils, made of aluminum, nickel, chromium, stainless steel, or the like; plastic films providing a thin film composed of metal or electrically conductive substances; and papers or plastic films with coating or impregnating agents imparting electrical conductivity.

In the present invention, an undercoating layer may be established on the electrically conductive support, as shown in FIGS. 2, 4, and 6. The undercoating layer is effective for preventing the injection of unrequired charge from the electrically conductive support and acts to increase the chargeability of the photosensitive layer. Moreover, it also acts to increase the adhesion between the photosensitive layer and the electrically conductive support. Materials which can be used to form the undercoating layer include poly(vinyl alcohol), polyvinylpyrrolidone, polyvinylpyridine, cellulose ethers, cellulose esters, polyamide, polyurethane, casein, gelatin, poly(glutamic acid), starch, starch acetate, amino starch, polyacrylic acid, and polyacrylamide. Among these, polyvinyl alcohol, polyamide, and polyurethane are preferred. The thickness of the undercoating layer is preferably from about 0.05 to 2 μm.

EXAMPLES

The invention is further described by reference to the following examples below. Unless otherwise indicated, all parts, percents and ratios are by weight.

Example 1

Preparation of polycyclic quinone type pigment which is subjected to an acid pasting treatment 7.0 g of dibromoanthoanthrone (C.I. Pigment Red 68) as a polycyclic quinone type pigment was completely dissolved into 200 g of concentrated sulfuric acid. The solution obtained was added dropwise to 2000 ml of water. The water was maintained at 10° C. or less. After the resulting mixture was allowed to stand for one day, it was then filtered and washed with water, aqueous ammonia, water and methyl alcohol in that order, and then was dried sufficiently to obtain 6.3 g of the desired pigment. The pigment obtained had a sulfur content of 80 ppm.

These samples were prepared using ten parts of a dibromoanthoanthrone ("Monolight Red 2Y") which had been acid pasted to provide sulfur contents of 220 and 380 ppm by washing with water, aqueous ammonia, water and methyl alcohol. Each of the above was mixed with 1 part of polyvinylbutyral (BM-1, made by the Sekisui Kagaku Co.) and 100 parts of cyclohexanone. The mixture was dispersed by a treatment, using glass beads as a dispersing medium, for a period of 1 hour in a paint shaker, after which the mixture was coated onto an aluminum support using a Mayer bar. The coating was then dried at 100° C. for a period of 5 minutes to form a charge generating layer having a thickness of 0.5 μm.

Next, 1 part of N,N'-diphenyl-N,N'-bis(3-methylphenyl)-[4,4'-biphenyl]-4,4'-diamine represented by formula [II] below and 1 part of poly(4,4'-cyclohexylidenediphenylene carbonate (MW: 26,000) represented by formula [III] below, were mixed, as charge transporting materials, with 8 parts of monochlorobenzene to form a solution. The mixture so obtained was coated in the charge generating layer with a Mayer bar and dried for 1 hour at 120° C. to form a charge transporting layer of thickness 20 μm.

The electrophotographic characteristics of each of the electrophotographic photoreceptors so obtained was determined using an electrostatic copy paper testing apparatus (SP-428, manufactured by the Kawaguchi Denki Co.) with a corona discharge at 40 μA and exposure with a luminance of 5 lux after maintaining the body in the dark for a period of 1 second. The results obtained upon measuring the initial voltage $V_o$ (volts), the retention factor after 1 second, DD (%) and the half reduction exposure $E_{\frac{1}{2}}$ (lux·seconds) were as shown in Table 1.

It is clearly seen from the results shown in table 1 that the chargeability is high and the dark decay coefficient is low for electrophotographic photoreceptors using pigments which have been acid pasted so that the sulfur content is 500 ppm or less. The copy image quality was also good. Moreover, 10,000 repeat copies were made and there was no change in image quality.

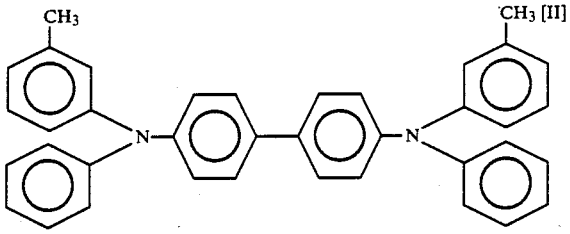

[III]

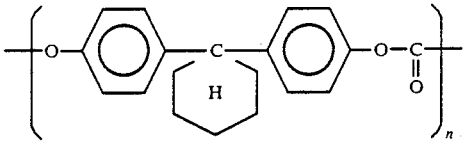

Here n is the degree of polymerization

Comparative Example 1

Electrophotographic photoreceptors were prepared in the same manner as in example 1 except that dibromoanthoanthrone which had been acid pasted so as to provide sulfur contents of about 650, 1100 and 2300 ppm was used, and these were evaluated in the same manner as before. The results obtained were as shown in Table 1.

It is clearly seen from the results shown in table 1 that the chargeability is reduced and the dark decay coefficient is increased when a material which has a sulfur content greater than 500 ppm is used.

Example 2

A solution obtained by dissolving 1 part of "Rakkamaito 5003" in 9 parts of methanol was coated with a Mayer bar onto an aluminum support and dried for 5 minutes at 100° C. to form an undercoating layer of thickness 0.5 μm.

These samples were prepared using one part of vanadium phthalocyanine represented by formula [IV] below which had been acid pasted so as to provide sulfur contents of 100, 250 and 400 ppm. Each was mixed with 5 parts of polycarbonate ("Panraito L-1250, manufactured by the Teijin Kasei Co.), 2 parts of N,N'-diphenyl-N,N'-bis(3-methylphenyl)-[4,4'-biphenyl]-4,4'-diamine represented by formula [II] above as a charge transporting material and 3 parts of monochlorobenzene. Each mixture was dispersed by treating, using glass beads as a dispersing medium, for 1 hour in a paint shaker, after which the mixture obtained was coated with a Mayer bar onto an aluminum support and dried for 1 hour at 120° C. to form a photoconductive layer of thickness 15 μm.

[IV]

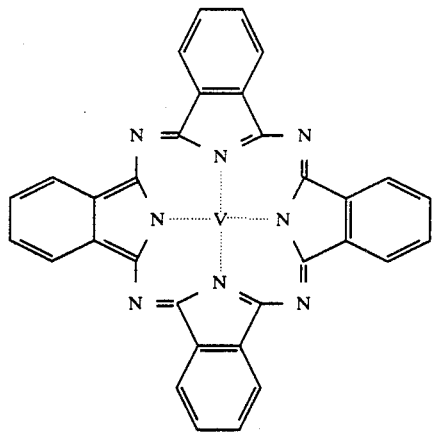

The electrophotographic characteristics of each of the electrophotographic photoreceptors so obtained were determined in the same manner as in example 1. The results obtained are shown in table 1.

It is clearly seen from the results shown in table 1 that the chargeability was high and the dark decay coefficient was low with the electrophotographic photoreceptors in which a pigment was used which had been acid pasted so as to provide a sulfur content of 500 ppm or less. The other electrophotographic characteristics were also good.

Comparative Example 2

Electrophotographic photoreceptors were prepared in the same manner as in example 2 except that the samples contained vanadium phthalocyanine which had been acid pasted so as to provide sulfur contents of about 620, 1000, and 3300 ppm was used. These were each evaluated in the same manner as before. The results obtained are shown in table 1.

It is clearly seen from the results shown in table 1 that the chargeability is reduced and the dark decay coefficient increases when a material which has a sulfur content greater than 500 ppm is used.

Example 3

Vapor deposited titanium on a polyethylene film was used as an electrically conductive support.

Three samples were prepared using nine parts of dibenzimidazoleperylene represented by formula [V] below which had been acid pasted so as to provide sulfur contents of 70, 180 and 360 ppm. Each was mixed with 1 part of poly-N-vinylcarbazole, 50 parts of tetrahydrofuran and 50 parts of toluene. The mixture was dispersed by treating for 5 days using glass beads as a dispersion medium, in a ball mill. The mixture obtained was coated with a Mayer bar onto the above mentioned electrically conductive support and dried for 5 minutes at 100° C. to form a charge generating layer having a thickness of 0.5 μm. Next, 1 part of N,N'-diphenyl-N,N'-bis(3-methylphenyl)-[4,4'-biphenyl]-4,4'-diamine of the aforementioned formula [II] and 1 part of poly(4,4'-cyclohexylidenediphenyl carbonate) as charge transporting materials, and 8 parts of monochlorobenzene were mixed together to form a solution. This solution was coated onto each of the charge generating layers with a Mayer bar and dried for 1 hour at 100° C. to form a charge transporting film of thickness 20 μm.

[V]

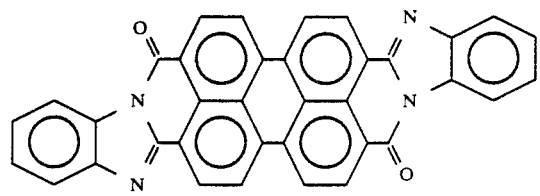

The electrophotographic characteristics of the electrophotographic photoreceptors so obtained were determined in the same manner as in example 1. The results obtained are shown in table 1.

It is clearly seen from the results shown in table 1 that the chargeability is high and the dark decay coefficient is low with the electrophotographic photoreceptors in which a pigment which has been acid pasted in such a way that the sulfur content is 500 ppm or less is used. Furthermore the other electrophotographic characteristics were also good.

Comparative Example 3

Electrophotographic photoreceptors were prepared in the same manner as in example 3 except that dibenzimidazoleperylene which had been acid pasted so as to provide a sulfur content of about 700, 1250 and 2200 ppm was used to prepare the samples. These were evaluated in the same manner as before. The results obtained are shown in table 1.

It is clearly seen from the results shown in table 1 that the chargeability is reduced and the dark decay coefficient is increased when a material which has a sulfur content greater than 500 ppm is used.

TABLE 1

| | Sulfur Content (ppm) | $V_o$ (V) | DD (%) | $E_{\frac{1}{2}}$ (Lux · Sec) |
|---|---|---|---|---|
| Example 1 | 80 | −1020 | 1.5 | 2.6 |
| | 220 | −1010 | 1.3 | 2.7 |
| | 380 | −1020 | 1.4 | 2.6 |
| Comparative Ex. 1 | 650 | −950 | 1.9 | 2.8 |
| | 1100 | −910 | 2.3 | 2.6 |
| | 2300 | −870 | 3.0 | 3.0 |
| Example 2 | 100 | −900 | 0.8 | 2.0 |
| | 250 | −920 | 1.0 | 2.1 |
| | 400 | −900 | 1.3 | 2.0 |
| Comparative Ex. 2 | 620 | −800 | 2.9 | 2.1 |
| | 1000 | −700 | 3.5 | 1.9 |
| | 3300 | −500 | 5.5 | 2.1 |
| Example 3 | 70 | −860 | 1.7 | 4.0 |
| | 180 | −840 | 1.5 | 4.1 |
| | 360 | −840 | 1.8 | 4.1 |
| Comparative Ex. 3 | 700 | −700 | 3.5 | 4.1 |
| | 1250 | −500 | 4.0 | 4.1 |
| | 2200 | −400 | 5.5 | 3.9 |

$V_o$: Dark potential on charging
DD(%): Dark decay coefficient $$DD = \frac{V_o - V_1}{V_1}$$

(Where $V_1$ is the dark potential of 1 second after charging)
$E_{\frac{1}{2}}$: Half reduction exposure.

Effect of the Invention

When organic pigments which have been acid pasted to provide a sulfur content of 500 ppm or less are used in the electrophotographic photoreceptor of the present invention, the electrophotographic characteristics such as the chargeability etc. do not vary. Hence, electrophotographic photoreceptors which have a high chargeability and a low dark decay coefficient can be obtained by means of the invention.

Having described preferred embodiments of the present invention, it is to be recognized that variations and modifications thereof falling within the spirit and scope of the invention may become apparent to those skilled in the art, and the scope of the invention is to be determined by the appended claims and their equivalents.

What is claimed is:

1. An electrophotographic photoreceptor comprising an electrically conductive support having thereon a photosensitive layer comprising a binder and a polycyclic quinone type pigment as a charge generating material, which has been subjected to an acid pasting treatment, wherein the sulfur content of said organic pigment is 500 ppm or less.

2. The electrophotographic photoreceptor as claimed in claim 1, wherein said photosensitive layer comprises a charge generating layer and a charge transporting layer.

3. The electrophotographic photoreceptor as claimed in claim 2, wherein the ratio of the organic pigment to the binder resin contained in the charge generating layer ranges from 40/1 to 1/40.

4. The electrophotographic photoreceptor as claimed in claim 2, wherein the ratio of the charge transporting material to the binder resin contained in the photosensitive layer ranges from 1/20 to 20/1 and the ratio of the organic pigment to the charge transporting material contained in the photosensitive layer ranges from 1/20 to 1/1.

5. The electrophotographic photoreceptor as claimed in claim 1, wherein the sulfur content of said organic pigment is 400 ppm or less.

6. The electrophotographic photoreceptor as claimed in claim 3, wherein the ratio of organic pigment to binder resin contained in the charge generating layer ranges from 20/1 to ½.

7. The electrophotographic photoreceptor as claimed in claim 4, wherein the ratio of the charge transporting material to the binder resin contained in the photosensitive layer ranges from 1/10 to 10/1 and the ratio of the organic pigment to the charge transporting material contained in the photosensitive layer ranges from 1/10 to 1/1.

8. The electrophotographic photoreceptor as claimed in claim 1, wherein said polycyclic quinone type pigment is at least one pigment selected from the group consisting of dibromoanthoanthrone, chlorinated anthroanthrone, dibenzylpyrenequinone, pyrenequinone, brominated dibenzylpyrenequinone, pyranthrone, brominated pyranthrone, biolanthrone, isobiolanthrone, dianthroquinone, benzoanthroneacridine, acridonecarbazone, dinaphthroylacridone, anthraquinonethiazole and flavanthrone.

* * * * *

UNITED STATES PATENT AND TRADEMARK OFFICE

CERTIFICATE OF CORRECTION

PATENT NO. : 5,130,218

DATED : July 14, 1992

INVENTOR(S) : Motoko Yokokawa et al.

It is certified that error appears in the above-identified patent and that said Letters Patent is hereby corrected as shown below:

Title Page, Title, change "CHARGE ABILITY" to --CHARGEABILITY--.

Claim 1, column 9, line 15, Delete "organic".

Claim 3, column 9, line 22, Delete "organic".

Claim 4, column 10, line 1, Delete "organic".

Claim 5, column 10, line 5, Delete "organic".

Claim 6, column 10, line 8, Delete "organic".

Claim 7, column 10, line 15, Delete "organic".

Claim 8, column 10, line 21, change "anthroanthrone" to --anthoanthrone--.

UNITED STATES PATENT AND TRADEMARK OFFICE

CERTIFICATE OF CORRECTION

PATENT NO. : 5,130,218

DATED : July 14, 1992

INVENTOR(S) : Motoko Yokokawa et al

It is certified that error appears in the above-indentified patent and that said Letters Patent is hereby corrected as shown below:

Claim 8, column 10, line 22, change "anthroanthrone" to --anthoanthrone--.

Signed and Sealed this

Twelfth Day of October, 1993

Bruce Lehman

*Attest:*

BRUCE LEHMAN

*Attesting Officer*

*Commissioner of Patents and Trademarks*